US010050398B2

(12) United States Patent
Chousal et al.

(10) Patent No.: US 10,050,398 B2
(45) Date of Patent: Aug. 14, 2018

(54) DOCK CONNECTOR

(71) Applicant: Hewlett-Packard Development Company, L. P., Houston, TX (US)

(72) Inventors: Ivan Dejesus Chousal, Chula Vista, CA (US); Ben Wynne, San Diego, CA (US); Samiel H Chau, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/306,684

(22) PCT Filed: Jul. 31, 2014

(86) PCT No.: PCT/US2014/049035
§ 371 (c)(1),
(2) Date: Oct. 25, 2016

(87) PCT Pub. No.: WO2016/018335
PCT Pub. Date: Feb. 4, 2016

(65) Prior Publication Data

US 2017/0063012 A1 Mar. 2, 2017

(51) Int. Cl.
*H01R 11/30* (2006.01)
*H01R 33/74* (2006.01)
*H01R 13/62* (2006.01)

(52) U.S. Cl.
CPC ..... *H01R 33/74* (2013.01); *H01R 13/6205* (2013.01)

(58) Field of Classification Search
CPC ..... H01R 13/6205; H01R 33/74
(Continued)

(56) References Cited

U.S. PATENT DOCUMENTS 5,440,449 A * 8/1995 Scheer ..... G06F 1/1615 361/679.28
5,628,055 A * 5/1997 Stein ..... H04B 1/38 375/222
(Continued)

FOREIGN PATENT DOCUMENTS

CN 1765059 4/2006
CN 101681186 3/2010
(Continued)

OTHER PUBLICATIONS

Bogdan Popa, "Microsoft Releases the Surface Docking Station for Enhanced Battery, Connectivity," Sep. 23, 2013, pp. 1-2, Softpedia, Available at: <news.softpedia.com/>.
(Continued)

*Primary Examiner* — Michael A Lyons
*Assistant Examiner* — Milagros Jeancharles
(74) *Attorney, Agent, or Firm* — Trop Pruner & Hu PC

(57) ABSTRACT

A dock connector support structure is to mate with a corresponding structure of a mating connector. A magnet magnetically attaches the dock connector support structure to the corresponding structure of the mating connector. A signal contact and a further contact are supported by the dock connector support structure. The signal contact is to communicatively connect with a contact of the mating connector. The further contact is selected from among a high-power contact to supply power in excess of five watts, and a wireless element contact to connect to a wireless communication element.

17 Claims, 2 Drawing Sheets

(58) Field of Classification Search
USPC ..... 439/38–40, 557, 831
See application file for complete search history.

(56) References Cited

U.S. PATENT DOCUMENTS

| | | | | |
|---|---|---|---|---|
| 5,864,708 | A * | 1/1999 | Croft | G06F 1/1632 370/521 |
| 7,230,822 | B2 * | 6/2007 | Langberg | G11B 33/122 248/917 |
| 7,559,803 | B2 * | 7/2009 | Mukai | H01R 13/6625 439/620.09 |
| 7,599,561 | B2 | 10/2009 | Wilson et al. | |
| 7,632,114 | B2 * | 12/2009 | Danner | H01R 27/00 439/131 |
| 7,710,391 | B2 | 5/2010 | Bell et al. | |
| 7,783,070 | B2 * | 8/2010 | Fadell | G06F 1/1632 381/123 |
| 8,121,640 | B2 | 2/2012 | Russ et al. | |
| 8,199,117 | B2 | 6/2012 | Izadi et al. | |
| 8,467,829 | B2 * | 6/2013 | Fadell | G06F 1/1632 455/556.1 |
| 8,497,657 | B2 | 7/2013 | Franks et al. | |
| 8,736,583 | B2 | 5/2014 | Anderson et al. | |
| 8,797,999 | B2 * | 8/2014 | Pance | H04Q 3/0029 370/331 |
| 8,964,372 | B2 * | 2/2015 | Morton | G06F 1/1632 361/679.4 |
| 9,413,087 | B2 * | 8/2016 | Shariff | H01R 24/20 |
| 9,438,714 | B2 * | 9/2016 | Gajdos | H04M 1/04 |
| 9,495,307 | B2 * | 11/2016 | Zadesky | G06F 13/122 |
| 9,753,506 | B2 * | 9/2017 | Saroor | G06F 1/203 |
| 2002/0032042 | A1 * | 3/2002 | Poplawsky | B60R 11/0241 455/564 |
| 2002/0115480 | A1 * | 8/2002 | Huang | H02J 7/0027 455/573 |
| 2002/0132651 | A1 * | 9/2002 | Jinnouchi | H04B 1/3888 455/573 |
| 2002/0163780 | A1 * | 11/2002 | Christopher | G06F 1/1632 361/679.31 |
| 2003/0059022 | A1 * | 3/2003 | Nebiker | H04L 12/58 379/219 |
| 2003/0198015 | A1 * | 10/2003 | Vogt | G06F 1/1626 361/679.03 |
| 2003/0218445 | A1 * | 11/2003 | Behar | H02J 7/0044 320/114 |
| 2004/0151327 | A1 * | 8/2004 | Marlow | G11B 27/002 381/86 |
| 2005/0078092 | A1 | 4/2005 | Clapper | |
| 2006/0039263 | A1 * | 2/2006 | Trotabas | B60R 11/02 369/86 |
| 2007/0035917 | A1 * | 2/2007 | Hotelling | G06F 1/1632 361/679.56 |
| 2007/0230723 | A1 * | 10/2007 | Hobson | H01R 13/748 381/300 |
| 2007/0247439 | A1 * | 10/2007 | Daniel | G06F 1/1601 345/173 |
| 2008/0018591 | A1 | 1/2008 | Pittel et al. | |
| 2008/0123285 | A1 * | 5/2008 | Fadell | G06F 1/1632 361/679.41 |
| 2008/0165066 | A1 * | 7/2008 | Tiscareno | H01Q 1/242 343/702 |
| 2011/0039426 | A1 | 2/2011 | Lee | |
| 2011/0242054 | A1 | 10/2011 | Tsu | |
| 2012/0021619 | A1 | 1/2012 | Bilbrey et al. | |
| 2012/0202427 | A1 | 8/2012 | Gioscia et al. | |
| 2013/0077236 | A1 | 3/2013 | Becze et al. | |
| 2013/0137298 | A1 | 5/2013 | Vroom et al. | |
| 2013/0242475 | A1 | 9/2013 | Sloey | |
| 2013/0346661 | A1 | 12/2013 | Hasenei | |
| 2014/0330998 | A1 * | 11/2014 | Dees | H04M 1/72527 710/303 |
| 2015/0093922 | A1 * | 4/2015 | Bosscher | H01R 13/665 439/39 |

FOREIGN PATENT DOCUMENTS

| | | | |
|---|---|---|---|
| CN | 103779726 | | 5/2014 |
| EP | 2722936 | | 4/2014 |
| JP | 2006-294349 | A | 10/2006 |
| JP | 2010-219531 | A | 9/2010 |
| KR | 10-2008-0040313 | A | 5/2008 |

OTHER PUBLICATIONS

HP Smart Buy 230w Advanced Docking Station, 2014, 1 page, PC Connection, Inc., <pcconnection.com/product/hp-smart-buy>.

Shahram et al., "C-Slate: A Multi-Touch and Object Recognition System for Remote Collaboration using Horizontal Surfaces," IEEE Int'l Workshop~HIHCS, 2007, pp. 3-10.

Korean Intellectual Property Office, International Search Report and Written Opinion for PCT/US2014/049035 dated Apr. 29, 2015 (11 pages).

* cited by examiner

DOCK CONNECTOR

BACKGROUND

Various accessory devices can be connected to an electronic device, such as a computer or other type of electronic device. Examples of accessory devices include user input devices, such as a mouse device, a keyboard, and so forth. One type of interface that can be used to connect an accessory device to an electronic device is a Universal Serial Bus (USB) interface.

BRIEF DESCRIPTION OF THE DRAWINGS

Some implementations are described with respect to the following figures.

DETAILED DESCRIPTION

An accessory device can refer to any device that is connectable to a base electronic device, such as a computer (e.g. notebook computer, desktop computer, etc.), a handheld device (e.g. a smartphone, a personal digital assistant, etc.), a game appliance, a household appliance, a vehicle (e.g. a car, a boat, an aircraft, etc.), or any other type of electronic device. In some examples, an accessory device can be connected to a base electronic device using an electrical cable that has a connector at its end. The connector can plug into a respective port of the base electronic device. As an example, the connector can be a Universal Serial Bus (USB) connector.

As more features become available on accessory devices, existing, connectors may no longer be adequate to support the, accessory devices. For example, an accessory device may include multiple different user interface components (e.g. a first user interface component may include an assembly of buttons while a second user interface component may include a touch-sensitive surface). It may be difficult to use a single USB or other traditional connector to connect to the multiple user interface components, for example. An accessory device may include other or additional features that may not be connectable to a base electronic device using a single USB, or other traditional connector.

In accordance with some implementations, a dock connector is provided to allow for multiple features of an accessory device to be coupled to a base electronic device. User convenience can be enhanced by using the dock connector according to some implementations instead of multiple traditional connectors.

Figure 1:
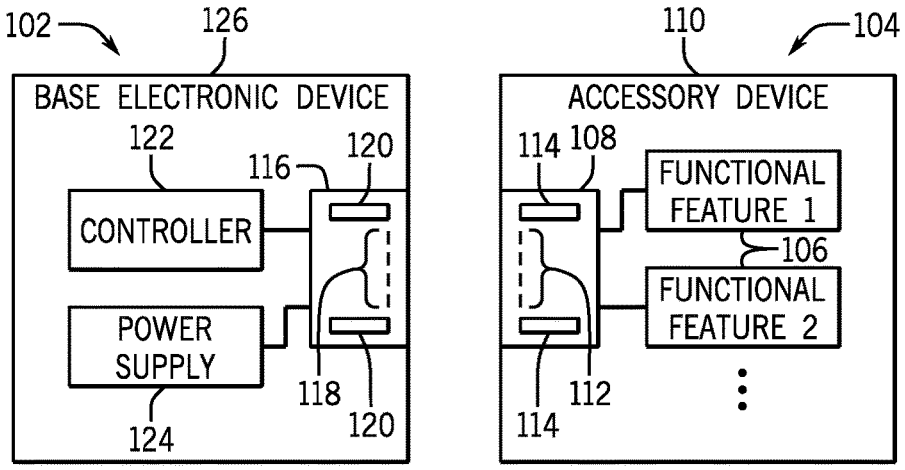
FIG. 1 is a block diagram of an example arrangement that includes an electronic device and an accessory device that is connectable to the electronic device using a dock connector, according to some implementations.

FIG. 1 is a block diagram of an example arrangement that includes a base electronic device 102 and an accessory device 104. The accessory device 104 includes various functional features 106, depicted as functional feature 1, functional feature 2, and so forth. Examples of the functional features 106 include any or some combination of the following: a user input component, an antenna, a storage device, a processing device, or other functional features. More generally, a "functional feature" can refer to a feature that can functionally interact with the base electronic device 102.

The functional features 106 are connected to a dock connector 108 of the accessory device 104. The accessory device 104 has an outer housing 110 that defines an inner chamber in which the functional features 106 and the dock connector 108 are located. The dock connector 108 is supported by the outer housing 110, either directly or indirectly, using any of various attachment mechanisms.

The dock connector 108 includes a set of contacts 112. The contacts 112 are supported by a dock connector support structure of the dock connector 108. The dock connector support structure can be a printed circuit board on which the contacts 112 are provided, a connector housing that supports the contacts, a metal brace that supports the contacts, or any other type of support structure.

The dock connector 108 also includes magnets 114 that are used to magnetically attach the dock connector 108 to a mating connector 116 of the base electronic device 102. The mating connector 116 has a similar arrangement as the dock connector 108, including a set of contacts 118 and magnets 120 that are magnetically attracted to the magnets 114 of the dock connector 108. Although the connector of the base electronic device is referred to as the mating connector 116, note that this connector can also be referred to as a dock connector. Use of different terminology ("dock connector" and "mating connector") is to provide for ease of explanation.

Although two magnets are depicted as being part of each of the connectors 108 and 116, it is noted that in other examples, each connector 108 or 116 can include just one magnet, or more than two magnets.

The base electronic device 102 also includes a controller 122 that is connected to the mating connector 116. The controller 122 can be implemented using one or multiple devices, such as a microprocessor, a microcontroller, an application specific integrated circuit (ASIC) device, a programmable gate array (PGA), a digital signal processor, and so forth. The controller 122 can interact with the functional features 106 of the accessory device 110. Although depicted as a single block, it is noted that the controller 122 can include multiple devices in other examples. Also, in some examples, the controller 122 can further include machine-readable instructions (e.g. software or firmware) that are executable on a processing circuit of the controller 122.

The base electronic device 102 can also include a power supply 124 that can supply power to the mating connector 116, where this power can in turn be supplied through the dock connector 108 to the functional features 106 of the accessory device 110. The power supply 124 can receive power from a power source (e.g. a battery, an external power source such as AC power, solar power, network power, etc.).

The base electronic device 102 includes an outer housing 126 that defines an inner chamber in which the controller 122, power supply 124, and mating connector 116 are included.

In operation, the accessory device 110 can be brought into close proximity to the base electronic device 102. Interaction between the magnets 114 and 120 cause the connectors 108 and 116 to be pulled towards each other, such that a mating connection can be made between the connectors 108 and 116. Although not shown, in, some examples, one or multiple alignment elements can be included in the dock connectors 108 and 116 to align the connectors 108 and 116 as they are brought into contact with each other by the force of the magnetics 114 and 120.

The contacts 112 of the dock connector 108 can include a signal contact and a "further" contact in addition to other contacts). A "contact" can refer to a communication element of a connector that is to communicatively connect to a respective communication element of another connector. In some examples, a contact can be an electrical contact (e.g. an electrical pin, an electrical receptacle, etc.), which makes an electrical connection with a corresponding electrical contact of another connector. In other examples, a contact can be an optical element, (e.g. such as the end portion of an optical fiber or an optical wave guide) that can optically connect to a respective optical element in another connector.

Once the signal contact is communicatively connected (electrically connected or optically connected) with a respective contact of another connector, the signal contact can be used for performing signal communications, in which signals are communicated between endpoints (one endpoint in the accessory device 104 and the other endpoint in the base electronic device 102).

The "further" contact can include one or some combination of the following: a high-power contact and a wireless element contact. The high-power contact can be used to communicate power in excess of five watts, In some examples, the high-power contact can provide a voltage that is in excess of five volts (e.g. 19.5 volts or another voltage greater than five volts). A high-power contact is distinguished from a lower power contact, such as a power contact used in a USB connector. A USB connector can include a power contact that supplies a 5-volt voltage, and that can deliver power less than 2.5 watts for USB 2.0 and 4.5 watts for USB 3.0. In some examples, the high-power contact of the dock connector 108 can be used to supply power to a functional feature in the accessory device 110 that consumes higher power that cannot be supported using the power contact of a traditional connector, such as a USB connector.

The wireless element contact is used to connect to a wireless communication element, which can be one of the functional features 106 of the accessory device 110. The wireless communication element of the accessory device 110 can be used to perform wireless communications. In some examples, the wireless communication element can include an antenna that is able to perform radio frequency (RF) wireless communications. As examples, the antenna of the accessory device 104 can include a near field communication (NFC) antenna to perform communications according to an NFC communications protocol. In other examples, the antenna can be used to perform other wireless types of communications, such as Bluetooth communications, RF-ID communications, cellular network communications, and so forth.

Another example of a wireless communication element is an infrared (IR) communication element, to communicate using IR signals, Yet another example of a wireless communication element is an audio communication element that can communicate using audio signals.

Figure 2:
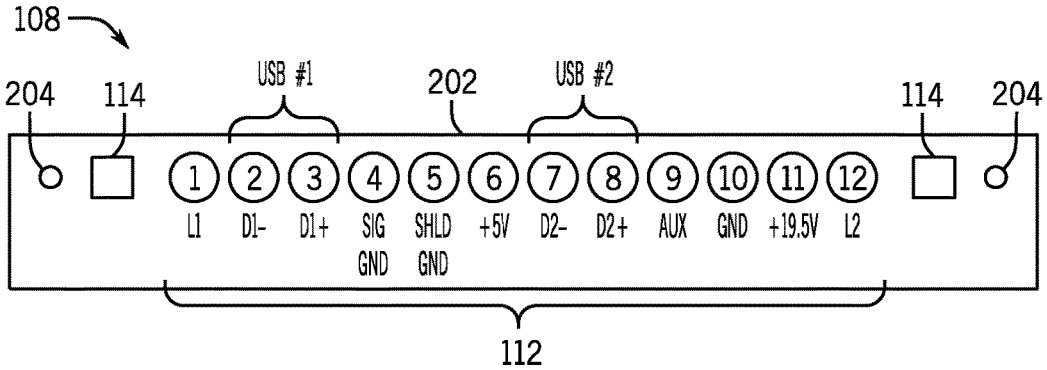
FIG. 2 is a schematic side view of various contacts of a dock connector, according to some implementations.

FIG. 2 is a schematic side view of the dock connector 108, according to some examples. Note that the mating connector 116 of the base electronic device 102 can have a similar arrangement as shown in FIG. 2. The dock connector 108 has a dock connector support structure 202, which supports the contacts 112. As shown in FIG. 2, the contacts 112 are arranged as a line of contacts, which in the orientation shown in FIG. 2 is a horizontal line.

The contacts 112 are labeled as contact 1, contact 2, . . . , contact 12, in the example of FIG. 2. Although a specific number of contacts are shown in FIG. 2, it is noted that in other examples, a different number of contacts can be part of the dock connector 108. The dock connector support structure 202 also supports the magnets 114, as well as alignment elements 204. Although two magnets 114 and two alignment elements 204 are shown in FIG. 2, it is noted that in other examples, a different number of magnets and alignment elements can be provided by the dock connector 108. The alignment elements can include posts or receptacles, for example, to mate with alignment elements of another connector.

The dock connector support structure 202 is arranged to mate (using the magnets 114 and the alignment elements 114, for example) with the corresponding dock connector support structure of another connector, such as the mating connector 118. Mating of the dock connector support structures of the two connectors can refer to causing the dock connector structures to be brought into engagement with each other such that the respective sets of contacts of the dock connectors can communicate with each other.

The contacts 112 include a first pair of signal contacts 2 and 3, which can communicate signals D1− and D1+, respectively. The pair of signal contacts 2 and 3 can communicate a differential signal, which includes a positive signal and a negative signal that together provide two complementary signals (D1+ and D1− in the example of FIG. 2). In some examples, the D1+ and D1− signals are data signals of a USB interface, as specified by USB standards. The pair of signal contacts 2 and 3 can be considered to be part of a first USB interface in the dock connector 108.

The dock connector 108 of FIG. 2 also includes a second pair of signal contacts 7 and 8, which are to communicate D2− and D2+ signals, respectively. The D2+ and D2− signals provide another complementary pair of signals, which can be part of a second USB interface in the dock connector 108.

Contact 4 provides a signal ground, and is for connection to a ground reference for signals communicated by the dock connector 108. Contact 5 provides a shield ground, and is for connection to a ground reference of the base electronic device 102 to provide shielding for mitigating electromagnetic interference.

Contact 6 is a lower power contact. In the example of FIG. 2, the lower power contact 6 provides a 5-volt power supply voltage, which can be supplied by the power supply 124 shown in FIG. 1, for example.

Contact 9 is an auxiliary contact to communicatively connect to an auxiliary contact of another connector. The auxiliary contact can be used to perform an auxiliary function. The auxiliary function can vary depending on the type of accessory device 110.

Contact 11 is a high-power contact, such as one to deliver power in excess of 5 watts. In the example of FIG. 2, the high-power contact 11 supplies a +19.5-volt power supply voltage, which can also be supplied by the power supply 124 of FIG. 1, for example. The ground reference for the high-power contact 11 is provided by ground contact 10.

Contacts 1 and 12 of the dock connector 108 are dock sense contacts used to provide a feedback indication of a connection between the dock connector 108 and the mating connector 116. When the feedback contacts 1 and 12 are connected to respective contacts of the mating connector 116, a loop can be formed, which can be detected by the controller 122 of the base electronic device 102 as an indication that connection has been made between the dock connector 108 and the mating connector 116.

Figure 3:
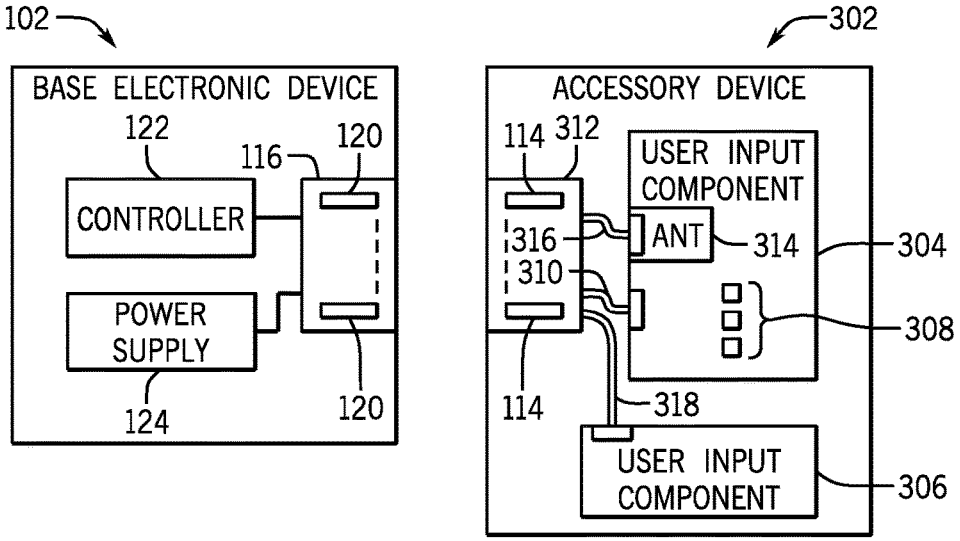
FIG. 3 is a block diagram of another example arrangement that includes an electronic device and an accessory device that is connectable to the electronic device using a dock connector, according to further implementations.

FIG. 3 is a block diagram of an example arrangement of the base electronic device 102 and an accessory device 302 according to alternative implementations. The accessory device 302 includes user input components 304 and 306. In some examples, the user input component 304 can include an arrangement of buttons 308 that are activatable by a user to provide input to the base electronic device 102. The buttons 308 of the user input component 304 can be capacitive-sense buttons, where a user touch of the respective button 308 is capacitively sensed. In other examples, the buttons 308 can be a different type of user-activatable button, such as a button where user depression of the button causes activation of an electrical signal.

The buttons 308 can be arranged on a circuit board, A cable 310 is connected between the circuit board and a dock connector 312 of the accessory device 302. Detection of activation of any or some combination of the buttons 308 can be communicated over the cable 310 to the dock connector 312.

The dock connector 312 is arranged similarly to the dock connector 108 of FIGS. 1 and 2, except that the set of contacts of the dock connector 312 differs from the set of contacts for the dock connector 108, as discussed further below in connection with FIG. 4.

In the example of FIG. 3, an antenna 314 is provided as part of the user input component 304. In a different example, the antenna 314 can be separate from the use input component 304. The antenna 314 is connected over an antenna cable 316 to the dock connector 312. If the antenna 314 is arranged on a circuit board, conductive traces on the circuit board and the cable 316 connect the antenna 314 to the dock connector 312. In a different example, instead of the antenna 314 a different wireless communication element can be provided, which is connected by a respective cable to the dock connector 312.

In some examples, the second user input component 306 can include a touch-sensitive surface and a touch controller to detect touches or gestures made by a user on the touch-sensitive surface. The touch controller can detect user finger touches or swipes and/or stylus touches or swipes on the touch-sensitive surface The detected touch inputs are communicated over a cable 318 to the dock connector 312.

Each of the cables 310, 316, and 318 in the accessory device 302 of FIG. 3 includes respective wires that are connected to respective subsets of the contacts of the dock connector 312. In other examples, the cables 310, 316, and 318 can be optical cables.

Figure 4:
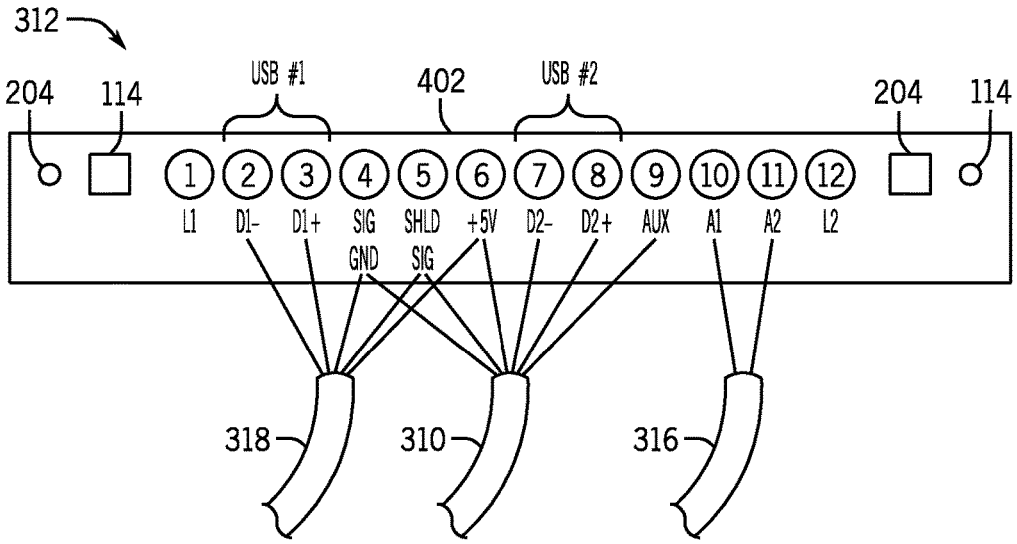
FIG. 4 is a schematic side view of various contacts of a dock connector, according to alternative implementations.

A schematic side view of the dock connector 312 is shown in FIG. 4. The dock connector 312 has a support structure 402 that supports contacts 1-12, magnets 114, and alignment elements 204. FIG. 4 also shows the connection of wires of the respective cables 318, 310, and 316 to the corresponding subsets of contacts of the dock connector 312. For example, the wires of the cable 318 from the touch controller of the user input component 306 connect to contacts 2, 3, 4, 5, and 6. The wires of the cable 310 from the user input component 304 are connected to contacts 4, 5, 6, 7. 8, and 9. The wires of the antenna cable 316 are connected to contacts 10 and 11.

In the dock connector 312 of FIG. 4, the high-power contact 11 and ground contact 10 that are part of the dock connector 108 of FIG. 2 have been replaced with antenna contacts that are used to communicate with the antenna 314 of the accessory device 302. Also, the auxiliary contact 9 in FIG. 4 is used to support a function of the user input component 304.

By using a dock connector according to some implementations, ease of connection between an accessory device that has multiple features and a base electronic device can be achieved.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. An accessory device comprising:

an antenna;

a first functional feature;

a second functional feature of a type different from the first functional feature; and a dock connector comprising:

a dock connector support structure to mate with a corresponding structure of a mating connector of an electronic device;

a magnet to magnetically attach the dock connector support structure to the corresponding structure of the mating connector; and a first signal contact, a second signal contact, a ground contact, a first power contact, a second power contact, and a wireless element contact that are supported by the dock connector support structure, the first signal contact to communicatively connect with a first contact of the mating connector, the first signal contact for signal communications and connected to the first functional feature, the second signal contact to communicatively connect with a second contact of the mating connector, the second signal contact for signal communications and connected to the second functional feature, the first power contact to supply a first voltage that is greater than a voltage of the ground contact, wherein the first power contact is to supply power to the first functional feature, the second power contact to supply a second voltage greater than the first voltage, wherein the second power contact is to supply power to the second functional feature, and the wireless element contact connected to the antenna.

2. The accessory device of claim 1, wherein the dock connector further comprises an alignment element to align the dock connector support structure with the corresponding structure of the mating connector.

3. The accessory device of claim 1, wherein the first signal contact, the second signal contact, the ground contact, the first power contact, the second power contact, and the wireless element contact are arranged as part of a line of contacts along the dock connector support structure.

4. The accessory device of claim 1, wherein the first signal contact is part of a first pair of signal contacts to communicate a first differential signal.

5. The accessory device of claim 4, wherein the second signal contact is part of a second pair of signal contacts supported by the dock connector support structure to communicate a second differential signal.

6. The accessory device of claim 5, wherein the first pair of signal contacts is part of a first Universal Serial Bus (USB) interface, and the second pair of signal contacts is part of a second USB interface.

7. The accessory device of claim 1, wherein the wireless element contact is connected to the antenna over an antenna cable.

8. The accessory device of claim 1, wherein the dock connector further comprises a dock sense contact supported by the dock connector support structure to electrically connect to a mating sense contact of the mating connector, wherein connection of the dock sense contact and the mating sense contact is to provide an indication of connection of the dock connector and the mating connector.

9. The dock accessory device of claim 1, wherein the dock connector further comprises an auxiliary contact supported by the dock connector support structure to communicatively connect with a corresponding contact of the mating connector, the auxiliary contact to provide an auxiliary function.

10. The accessory device of claim 1, wherein the dock connector support structure comprises a connector housing that supports the first signal contact, the second signal contact, the ground contact, the wireless element contact, the first power contact, and the second power contact.

11. The accessory device of claim 1, wherein the first functional feature comprises a first user interface component, and the second functional feature comprises a second user interface component.

12. An accessory device comprising:

an antenna;

a first user interface component;

a second user interface component of a type different from the first user interface component;

a dock connector to mate with a mating connector of an electronic device, wherein the dock connector comprises:

a dock connector support structure to mate with a corresponding structure of the mating connector of the electronic device;

a magnet to magnetically attach the dock connector support structure to the corresponding structure of the mating connector;

contacts to connect with contacts of the mating connector, the contacts of the dock connector arranged as a line of contacts along the dock connector support structure and comprising:

a first signal contact to communicatively connect with a first contact of the mating connector, the first signal contact for signal communications and connected to the first user interface component;

a second signal contact to communicatively connect with a second contact of the mating connector, the second signal contact for signal communications and connected to the second user interface component;

a wireless element contact connected to the antenna;

a ground contact;

a first power contact to supply a first voltage that is greater than a voltage of the ground contact, wherein the first power contact is to supply power to the first user interface component; and a second power contact to supply a second voltage greater than the first voltage, wherein the second power contact is to supply power to the second user interface component.

13. The accessory device of claim 12, further comprising an outer housing containing the antenna, the first user interface component, and the second user interface component, wherein the docking connector support structure is supported by the outer housing.

14. The accessory device of claim 12, wherein the first user input component includes a user-activatable button, and the second user input component includes a touch-sensitive surface.

15. An electronic device comprising:

a controller; and a dock connector coupled to the controller, the docking connector comprising:

a dock connector support structure to mate with a corresponding structure of a mating connector of an accessory device that includes a user input component;

a magnet to magnetically attach the dock connector support structure to the corresponding structure of the mating connector;

contacts to connect with contacts of the mating connector, the contacts arranged on the dock connector support structure and comprising:

a first group of signal contacts to communicatively connect with respective contacts of the mating connector, the first group of signal contacts for signal communications with the user input component of the accessory device;

a second group of signal contacts to communicatively connect with respective contacts of the mating connector, the second group of signal contacts for signal communications with another component of the accessory device;

a ground contact;

a first power contact to supply a first voltage that is greater than a voltage of the ground contact, the first power contact to supply power to the user input component;

a second power contact to supply a second voltage greater than the first voltage, the second power contact to supply power to the another component; and a wireless element contact to connect to a wireless communication element.

16. The electronic device of claim 15, wherein the wireless element contact is to electrically connect to a wireless element contact in the mating connector of the accessory device, the wireless element contact in the mating connector of the accessory device connected to an antenna in the accessory device.

17. The electronic device of claim 15, wherein the user interface component is a first user interface component, and the another component is another user interface component of a type different from the first user interface component.

* * * * *